US007341038B1

(12) United States Patent
Forish et al.

(10) Patent No.: US 7,341,038 B1
(45) Date of Patent: Mar. 11, 2008

(54) ENGINE COVER WITH EMBEDDED LEADS

(75) Inventors: John A. Forish, Huntertown, IN (US); Robert H. Owen, Columbia City, IN (US)

(73) Assignee: Federal - Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/619,199

(22) Filed: Jan. 3, 2007

Related U.S. Application Data

(60) Provisional application No. 60/870,146, filed on Dec. 15, 2006.

(51) Int. Cl.
*F02B 77/00* (2006.01)
*F02B 67/00* (2006.01)

(52) U.S. Cl. ..... 123/195 C; 123/195 E

(58) Field of Classification Search ..... 123/195 C, 123/195 E, 198 E, 90.38
See application file for complete search history.

(56) References Cited

U.S. PATENT DOCUMENTS

| | | | |
|---|---|---|---|
| 5,030,116 | A | 7/1991 | Sakai et al. |
| 5,390,648 | A | 2/1995 | Yanase |
| 5,743,235 | A | 4/1998 | Lueder |
| 5,754,398 | A | 5/1998 | Glovatsky et al. |
| 6,142,806 | A | 11/2000 | Yamashita et al. |
| 6,257,897 | B1 | 7/2001 | Kubota |
| 6,435,154 | B1 | 8/2002 | Simpson et al. |
| 6,494,174 | B1 | 12/2002 | Daly |
| 6,494,193 | B2 | 12/2002 | Weingaertner et al. |
| 6,502,547 | B2 | 1/2003 | Kennedy et al. |
| 6,843,217 | B2 | 1/2005 | Zwick et al. |
| 2002/0139344 | A1* | 10/2002 | Kitada et al. ..... 123/195 C |

FOREIGN PATENT DOCUMENTS

| | | | |
|---|---|---|---|
| JP | 11030130 | A | 2/1999 |
| JP | 2004027867 | A | 1/2004 |

* cited by examiner

*Primary Examiner*—Noah P. Kamen
(74) *Attorney, Agent, or Firm*—Robert L. Stearns; Dickinson Wright PLLC

(57) ABSTRACT

An engine cover for at least partially enclosing a portion of an engine. The engine cover includes a body having an inwardly-facing surface for facing an engine and an outwardly-facing surface opposite the inwardly-facing surface. The body also includes a plurality of through-apertures disposed in spaced relation to one another about the body for mounting the body to an engine. The engine cover also includes a plurality of sockets integral with the body and disposed in spaced relation to one another about the body. The engine cover also includes a plurality of leads extending different lengths within the body between the outwardly-facing surface and the inwardly-facing surface. The leads extend between a first end exposed in a first of the plurality of sockets and a second end exposed in a second of the plurality of sockets different than the first socket. The first ends of the leads are exposed in different sockets and the second ends of the leads are exposed in a common socket for engaging a single mating socket.

10 Claims, 1 Drawing Sheet

ENGINE COVER WITH EMBEDDED LEADS

CROSS-REFERENCE TO RELATED APPLICATIONS

This application claims the benefit of U.S. Provisional Patent Application Ser. No. 60/870,146 for an ENGINE COVER WITH EMBEDDED LEADS, filed on Dec. 15, 2006, which is hereby incorporated by reference in its entirety.

BACKGROUND OF THE INVENTION

1. Field of the Invention

The invention relates to an engine cover for enclosing at least a portion of an engine and more particularly to engine cover having a body and circuitry disposed in situ with respect to the body.

2. Description of Related Art

Internal combustion engines include many moving parts and it is often desirable to monitor the movement of these parts. In addition, it is often desirable to monitor other attributes of engine operation, such as temperature, voltage, and fluid pressure. Sensors can be disposed throughout the engine to monitor these various operational attributes as well as other attributes.

SUMMARY OF THE INVENTION

An engine cover for at least partially enclosing a portion of an engine. The engine cover includes a body having an inwardly-facing surface for facing an engine and an outwardly-facing surface opposite the inwardly-facing surface. The body also includes a plurality of through-apertures disposed in spaced relation to one another about the body for mounting the body to an engine. The engine cover also includes a plurality of sockets integral with the body and disposed in spaced relation to one another about the body. The engine cover also includes a plurality of leads extending different lengths within the body between the outwardly-facing surface and the inwardly-facing surface. The leads extend between a first end exposed in a first of the plurality of sockets and a second end exposed in a second of the plurality of sockets different than the first socket. The first ends of the leads are exposed in different sockets and the second ends of the leads are exposed in a common socket for engaging a single mating socket.

BRIEF DESCRIPTION OF THE DRAWINGS

Advantages of the present invention will become more readily appreciated when considered in connection with the following detailed description and appended drawings, wherein.

DETAILED DESCRIPTION OF THE PREFERRED EMBODIMENT

Figure 1:
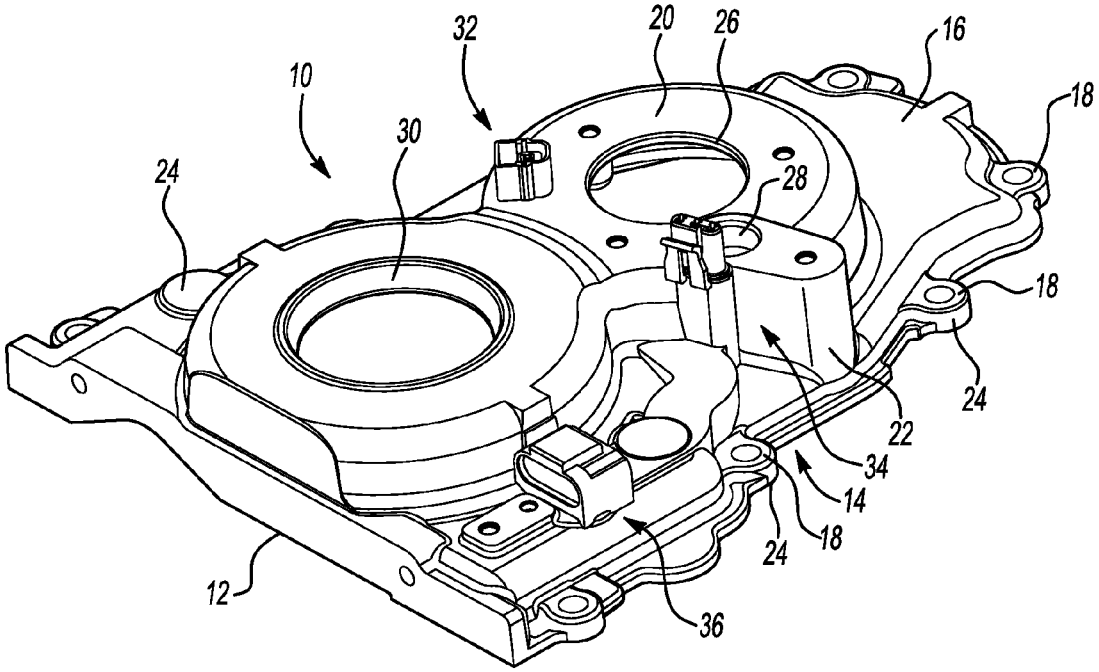
FIG. 1 is a first perspective view of an engine cover according to the exemplary embodiment of the invention.
Figure 2:
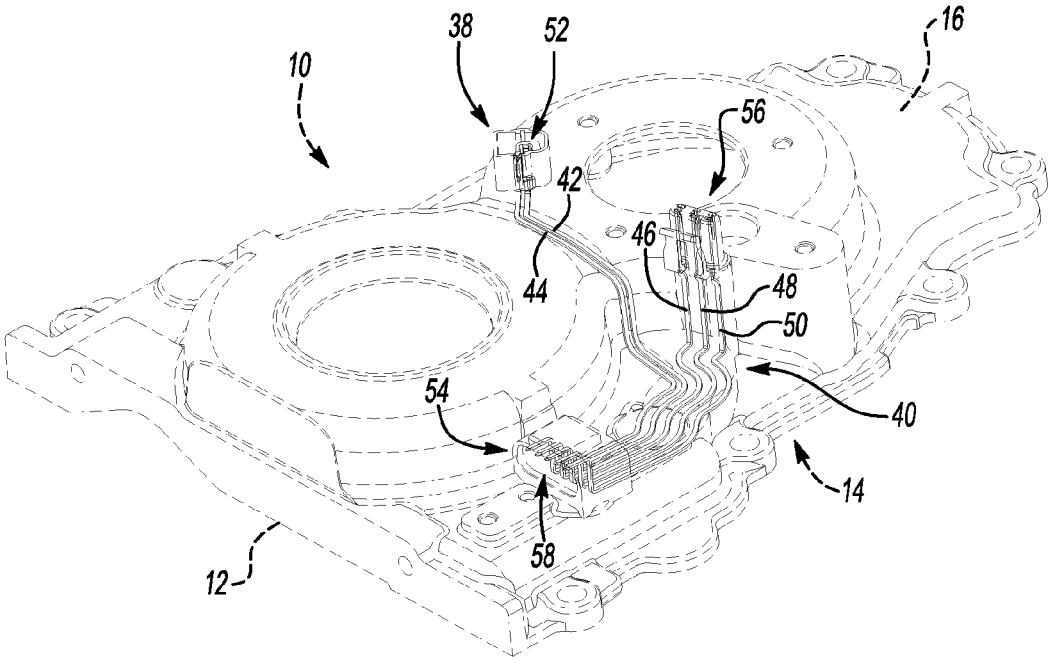
FIG. 2 is a second perspective view of the exemplary engine cover wherein a body of the cover is shown in phantom to show embedded leads extending through the body.

Referring now to FIGS. 1 and 2, an engine cover 10 for at least partially enclosing a portion of an engine. The engine cover 10 includes a body 12 having an inwardly-facing surface 14 for facing an engine and an outwardly-facing surface 16 opposite the inwardly-facing surface 14. The body 12 also includes a plurality of mounting apertures 18 disposed in spaced relation to one another about the body 12 for mounting the body 12 to an engine. The body 12 can be formed in any configuration in view of the operating environment. For example, the body 12 can be formed with projecting portions, such as projecting portions 20, 22 and with bosses, such as bosses 24. The body 12 can be configured to conform to the configuration of the portion of the engine to be enclosed.

In the exemplary embodiment of the invention, the mounting apertures are disposed about the periphery of the body 12. Also, the body 12 includes a plurality of access apertures 26, 28, 30 extending between the outwardly-facing surface 16 and the inwardly-facing surface 14 within the periphery to provide access to components of the engine. The access apertures can be any size and configuration; the exemplary access apertures 26, 28, 30 are sized differently from one another. The access aperture 26 provides access to a cam phaser. A cam phaser helps improve the efficiency and performance of the engine by adjusting the timing of the valve train of the engine. The access aperture 28 provides access to a camshaft of the engine. The access aperture 30 provides access to a crankshaft of the engine.

The engine cover 10 also includes a plurality of sockets 32, 34, 36 integral with the body 12 and disposed in spaced relation to one another about the body 12. Various embodiments of the invention can include any number of sockets and any configuration of sockets and any combination of configurations. The sockets may be all female, all male, or any combination of male and female sockets. The sockets may all extend from the same side of the body or may extend from different sides of the body. In the exemplary embodiment of the invention, the plurality of sockets 32, 34, 36 include the female sockets 32, 36 and the male socket 34. All of the sockets 32, 34, 36 in the exemplary embodiment of the invention extend from the outwardly-facing surface 16.

The socket 34 will be designated the "first socket" for illustrative purposes. The first socket 34 is disposed adjacent to the access apertures 28. The first socket 34 can mate with another socket associated with a position sensor. The position sensor would be disposed to sense the position of the camshaft of the engine. The socket 32 will be designated the "second socket" for illustrative purposes. The second socket 32 is disposed adjacent to the access apertures 26. The socket 32 can mate with another socket associated with the cam phaser. The socket 36 will be designated the "third socket" for illustrative purposes. The third socket 36 of the exemplary embodiment of the invention can be viewed as a central or primary socket and will be described in greater detail below.

Referring now to FIG. 2, the engine cover 10 also includes a plurality of leads 38, 40. The leads 38, 40 are not visible in FIG. 1 because the leads are embedded in the body 12. As used herein, a lead is an operable electrical connection between two points, capable of two-way or one-way electrical communication. The shown leads 38, 40 are flat, but in alternative embodiments of the invention the leads can be round wires. The exemplary lead 38 includes two flat metallic members 42, 44 extending between the access apertures 26, 30. The exemplary lead 40 includes three flat metallic members 46, 48, 50 extending only to the side of all the access apertures 26, 28, 30. In alternative embodiments of the invention, a lead may only include one member.

The leads 38, 40 extend different lengths within the body 12 between the outwardly-facing surface 16 and the inwardly-facing surface 14. The lead 38 extends between a first end 52 exposed in the socket 32 and a second end 54 exposed in the socket 36. The lead 40 extends between a first end 56 exposed in the socket 34 and a second end 58 exposed in the socket 36. Thus, the first ends 52, 56 of the leads 38, 40 are exposed in different sockets 32, 34 and the second ends 54, 58 of the leads are exposed in a common socket, the socket 36, for engaging a single mating socket. As a result, a plurality of different sensors and/or controllers can transmit signals and receive commands from a single electrical port or socket in a cover on the engine.

The body 12 of the engine cover 10 can be formed in a molding operation with plastics and/or resins that are capable of withstanding the operating environment of an engine compartment. The leads 38, 40 can be disposed in situ as the body 12 is molded.

Many modifications and variations of the present invention are possible in light of the above teachings. It is, therefore, to be understood that within the scope of the appended claims, the invention may be practiced otherwise than as specifically described.

What is claimed is:

1. An engine cover for at least partially enclosing a portion of an engine and comprising:

a body having an inwardly-facing surface for facing an engine and an outwardly-facing surface opposite said inwardly-facing surface and a plurality of through-apertures disposed in spaced relation to one another about a periphery of said body for mounting said body to an engine;

a plurality of access apertures each extending between said outwardly-facing surface and said inwardly-facing surface along a respective aperture axis within said periphery to provide access to components of the engine;

a plurality of sockets integral with said body and disposed in spaced relation to one another about said body including a first socket adjacent to a first of said plurality of access apertures and a second socket adjacent to a second of said plurality of access apertures different than said first of said plurality of access apertures and a third socket spaced closer to said first socket than said second socket, wherein all of said plurality of sockets project outwardly from said outwardly-facing surface so that said body may more closely conform to a shape of the engine, wherein said first and second sockets extend away from said outwardly-facing surface parallel to said respective axis of said first and second access apertures and wherein said third socket extends along an axis non-parallel to both of said first and second sockets; and a first plurality of leads extending different lengths within said body between said outwardly-facing surface and said inwardly-facing surface between a first end exposed in a first of said plurality of sockets and a second end exposed in a second of said plurality of sockets different than said first socket, wherein said first ends of said leads are exposed in different sockets and said second ends of said leads are exposed in a common socket for engaging a single mating socket, including a first lead having a first end exposed in said first socket and second end exposed in said third socket and a second lead having a first end exposed in said second socket and a second end disposed in said third socket and wherein at least some of said leads extend along torturous paths with curves in at least two planes.

2. The engine cover of claim 1 wherein each of said plurality of leads is further defined as comprising a plurality of flat metallic members.

3. The engine cover of claim 2 wherein at least two of said plurality of leads are defined as comprising a different number of metallic members with respect to one another.

4. The engine cover of claim 1 wherein said plurality of sockets are further defined as including at least one female socket.

5. The engine cover of claim 4 wherein said plurality of sockets are further defined as including at least male socket.

6. The engine cover of claim 1 wherein at least one of said plurality of leads extends between two of said plurality of access apertures.

7. The engine cover of claim 1 wherein at least one of said plurality of leads extends only to the side of all said plurality of access apertures.

8. The engine cover of claim 1 wherein at least two of said plurality of access apertures are differently sized from one another.

9. The engine cover of claim 1 wherein at least two of said plurality of sockets are differently configured from one another.

10. The engine cover of claim 9 wherein all of said plurality of sockets are differently configured from one another.

* * * * *